US011126117B1

(12) United States Patent
Kondo

(10) Patent No.: US 11,126,117 B1
(45) Date of Patent: Sep. 21, 2021

(54) FIXING DEVICE AND IMAGE FORMING APPARATUS PROVIDED WITH SAME

(71) Applicant: KYOCERA Document Solutions Inc., Osaka (JP)

(72) Inventor: Akihiro Kondo, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/193,012

(22) Filed: Mar. 5, 2021

(30) Foreign Application Priority Data

Mar. 9, 2020 (JP) ..... JP2020-039539

(51) Int. Cl.
*G03G 15/20* (2006.01)

(52) U.S. Cl.
CPC ..... *G03G 15/2025* (2013.01); *G03G 15/2064* (2013.01)

(58) Field of Classification Search
CPC ..... G03G 15/2025; G03G 15/2064
See application file for complete search history.

(56) References Cited

U.S. PATENT DOCUMENTS

2013/0004216 A1* 1/2013 Ikeda ..... G03G 15/2025 399/327
2014/0348527 A1* 11/2014 Murakami ..... G03G 15/2028 399/67

FOREIGN PATENT DOCUMENTS

| | | |
|---|---|---|
| JP | 2002-040860 | 2/2002 |
| JP | 2010-217466 | 9/2010 |
| JP | 2014-240869 | 12/2014 |

* cited by examiner

*Primary Examiner* — Sandra Brase
(74) *Attorney, Agent, or Firm* — Lex IP Meister, PLLC

(57) ABSTRACT

A fixing device is provided with a first rotating member, a second rotating member in contact with the first rotating member, a first drive motor for rotationally driving the first rotating member, a second drive motor for rotationally driving the second rotating member, a torque limiter provided between the second rotating member and the second drive motor, and a pressure adjusting mechanism for adjusting the nip pressure between the first rotating member and the second rotating member. When the nip pressure is greater than the maximum torque that can be transmitted by driving the torque limiter, the second rotating member rotates following the first rotating member and at the same linear speed as that of the first rotating member, and when the nip pressure is equal to or less than the maximum torque, the second rotating member rotates at a linear speed different from that of the first rotating member.

6 Claims, 8 Drawing Sheets

FIXING DEVICE AND IMAGE FORMING APPARATUS PROVIDED WITH SAME

INCORPORATION BY REFERENCE

This application is based upon and claims the benefit of priority from the corresponding Japanese Patent Application No. 2020-039539 filed on Mar. 9, 2020, the entire contents of which are incorporated herein by reference.

BACKGROUND

The present disclosure relates to a fixing device for fixing a toner image transferred onto a recording medium, and an image forming apparatus including the fixing device.

In a conventional electrophotographic image forming apparatus, an image forming process is executed in which a predetermined electrostatic latent image having a partially attenuated charge is formed on an image carrier such as a photosensitive drum uniformly charged by a charging device, by laser irradiation from an exposure device, toner is attached to the electrostatic latent image by a developing device to form a toner image, the toner image is transferred onto a paper (recording medium) by a transfer device, and the unfixed toner is heated and pressurized by a fixing device to form a permanent image.

The fixing device is a device for melting toner while conveying the paper by the fixing member composed of a heated rotating body such as a fixing roller and a fixing belt (hereinafter referred to as the fixing roller or the like) and a pressurizing member such as a pressurizing roller. As an example of such a fixing device, there is a roller fixing system in which a heating member is incorporated in the fixing roller, and the pressurizing roller is directly pressed against the fixing roller to form a fixing nip portion. In the roller fixing system, the fixing roller on the supporting surface (transfer surface) side of the unfixed toner image is generally driven to rotate at a necessary linear speed, and the pressurizing roller is rotationally driven by the fixing roller. Thus, it is possible to stably convey the paper without slipping, particularly on the transfer surface side, from the surface of the fixing roller, and the image can be fixed without being disturbed, with a simple configuration.

In a fixing process, the transfer surface of the paper directly contacts the fixing roller or the like. At this time, if a toner external additive or a wax component adheres to the surface of the fixing roller or the like, the surface releasing property may deteriorate to cause hot offset or toner adhesion, or the surface resistance may change to cause electrostatic offset. It is conceivable that the electrostatic offset can be dealt with by applying a voltage by the charging device, and a removal of adhered matter can be dealt with by adding a cleaning member. However, problems such as complication of a mechanism, increase in cost, return (re-adhesion) of adhered matter from the cleaning member to the fixing roller, etc., and securing of the life of the members are assumed. Therefore, it is preferable to prevent the toner external additive and the wax component from adhering to the fixing roller or the like.

In order to suppress the adhesion of toner external additives and wax components to the fixing roller or the like, it is necessary to set fixing conditions (surface layer material, nip pressure, fixing temperature, roller linear speed, driving time, and the like) in which the adhesion moves and circulates between pieces of paper from the fixing roller or the like to the pressure roller, and the adhesion shifts to the paper passing through the fixing nip portion at a level that is not visible. However, the roller fixing method in which there is no difference in linear speed between the fixing roller and the paper is disadvantageous in removal of the adhesion as compared with the belt heating method in which the fixing belt is used. This is because there is no action of physically stripping off the adhesion by sliding or rubbing due to the difference in linear speed between the fixing roller and the pressure roller at the fixing nip portion, and the adhesion tends to remain on the surface of the fixing roller.

SUMMARY

The fixing device of the present disclosure comprises a fixing member, a first drive motor, a second drive motor, a torque limiter, and a pressure adjusting mechanism. The fixing member comprises a first rotating member which is heated by a heating device, and a second rotating member which is brought into contact with the first rotating member to form a fixing nip portion. The first drive motor rotationally drives the first rotating member. The second drive motor rotationally drives the second rotating member at a linear speed different from that of the first rotating member. The torque limiter is provided between the second rotating member and the second drive motor. The pressure adjusting mechanism adjusts a nip pressure between the first rotating member and the second rotating member. The fixing device fixes a toner image on the recording medium by inserting a recording medium onto which the unfixed toner image has been transferred to the fixing nip portion and heating and pressurizing the recording medium. When the nip pressure is a first pressure greater than a maximum torque that can be transmitted by driving the torque limiter, the second rotating member rotates following the first rotating member and at a same linear speed as that of the first rotating member, and when the nip pressure is a second pressure equal to or less than the maximum torque that can be transmitted by driving the torque limiter, the second rotating member rotates at the linear speed different from that of the first rotating member.

DETAILED DESCRIPTION

Figure 1:
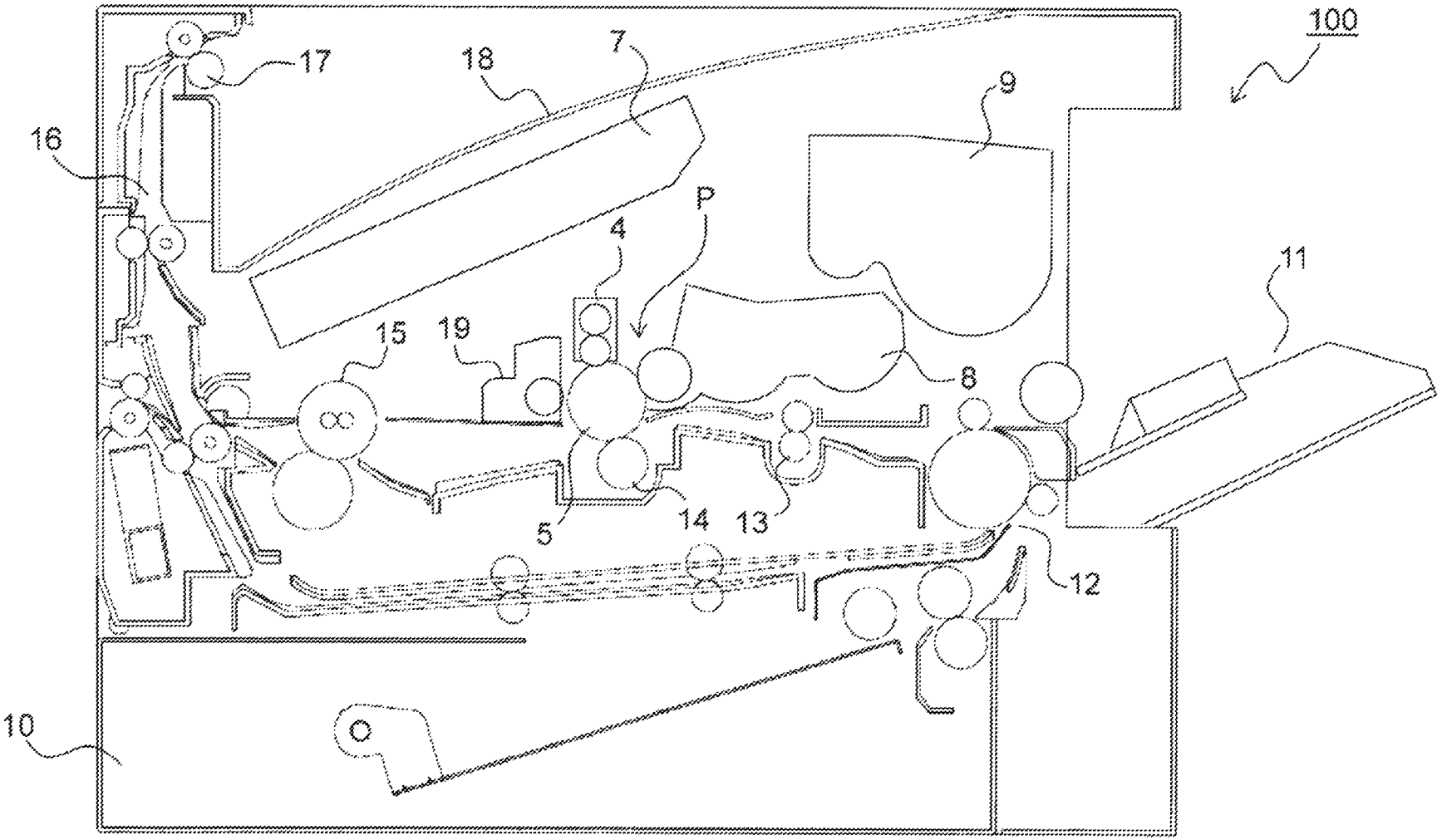
FIG. 1 is a side sectional view of an image forming apparatus provided with a fixing device according to the present disclosure.

Embodiments of the present disclosure will now be described with reference to the drawings. FIG. 1 is a side cross-sectional view of an image forming apparatus 100 provided with a fixing device 15 of the present disclosure. An image forming unit P for forming a monochrome image by charging, exposure, development and transfer is disposed in the image forming apparatus (for example, a monochrome printer) 100. The image forming unit P is provided with a charging device 4, an exposure device (laser scanning unit, etc.) 7, a developing device 8, a transfer roller 14, and a cleaning device 19 along a rotation direction (clockwise direction in FIG. 1) of a photosensitive drum 5.

Figure 4:
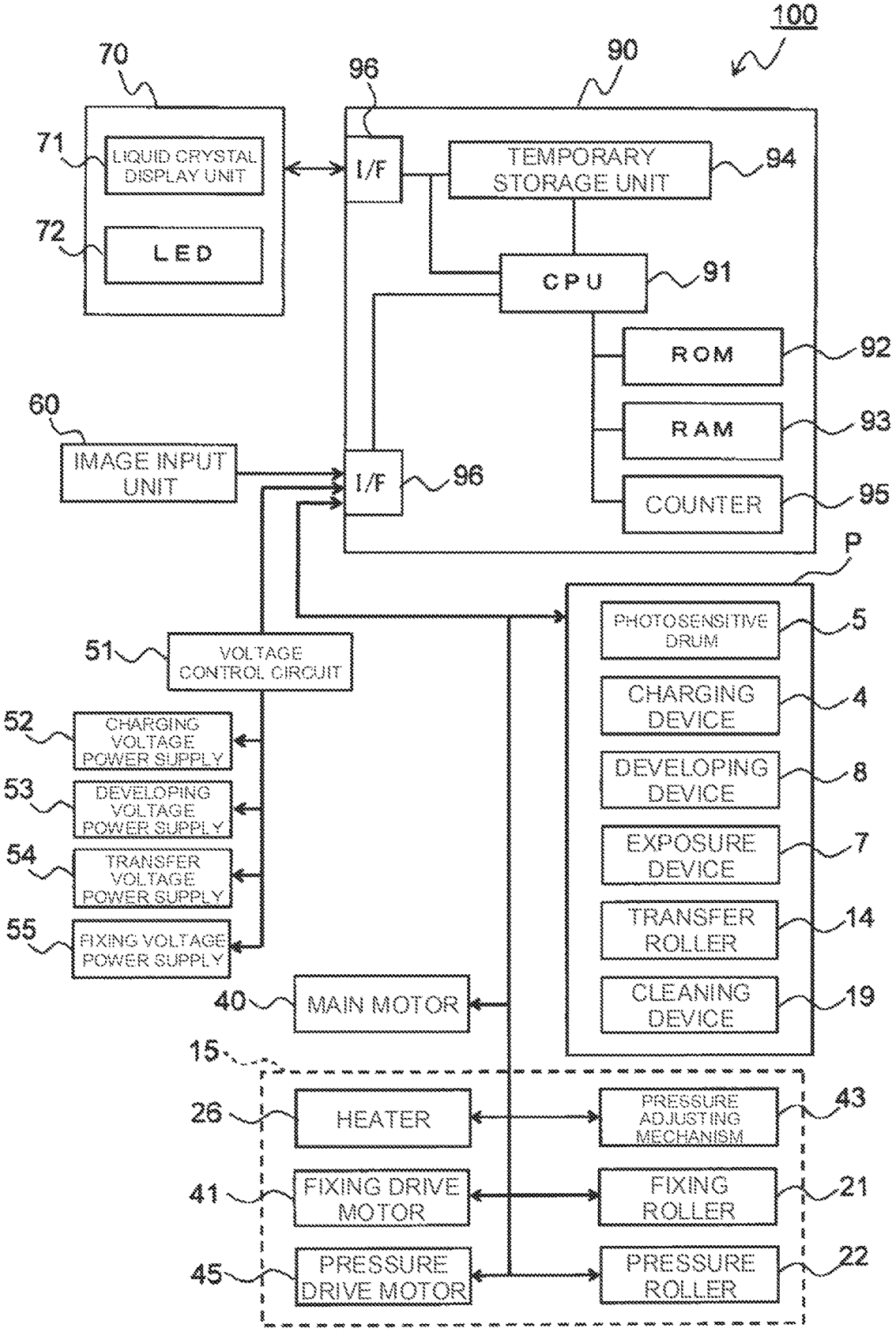
FIG. 4 is a block diagram showing an example of a control path of the image forming apparatus.

When an image forming operation is performed, the charging device 4 uniformly charges the surface of the photosensitive drum 5 rotating in the clockwise direction by a main motor 40 (see FIG. 4). Then, an electrostatic latent image is formed on the photosensitive drum 5 by a laser beam from the exposure device 7 based on document image data, and a developer (hereinafter, referred to as toner) is attached to the electrostatic latent image by the developing device 8 to form a toner image. The toner is supplied to the developing device 8 from a toner container 9. The image data is transmitted from an external device such as a personal computer. A static eliminator (not shown) for removing residual charge on the surface of the photosensitive drum 5 is provided downstream of the cleaning device 19 with respect to the rotating direction of the photosensitive drum 5.

Paper (recording medium) is conveyed from a paper feed cassette 10 or a manual paper tray 11 via a paper conveying path 12 and a registration roller pair 13 toward the photosensitive drum 5 on which the toner image has been formed as described above, and the toner image formed on the surface of the photosensitive drum 5 is transferred to the paper by the transfer roller 14 (image transfer device). The paper on which the toner image has been transferred is separated from the photosensitive drum 5, and is conveyed to the fixing device 15 to fix the toner image. The paper having passed through the fixing device 15 is conveyed to the upper portion of the image forming apparatus 100 by a paper conveying path 16, and is discharged to a discharge tray 18 by a discharge roller pair 17.

Figure 2:
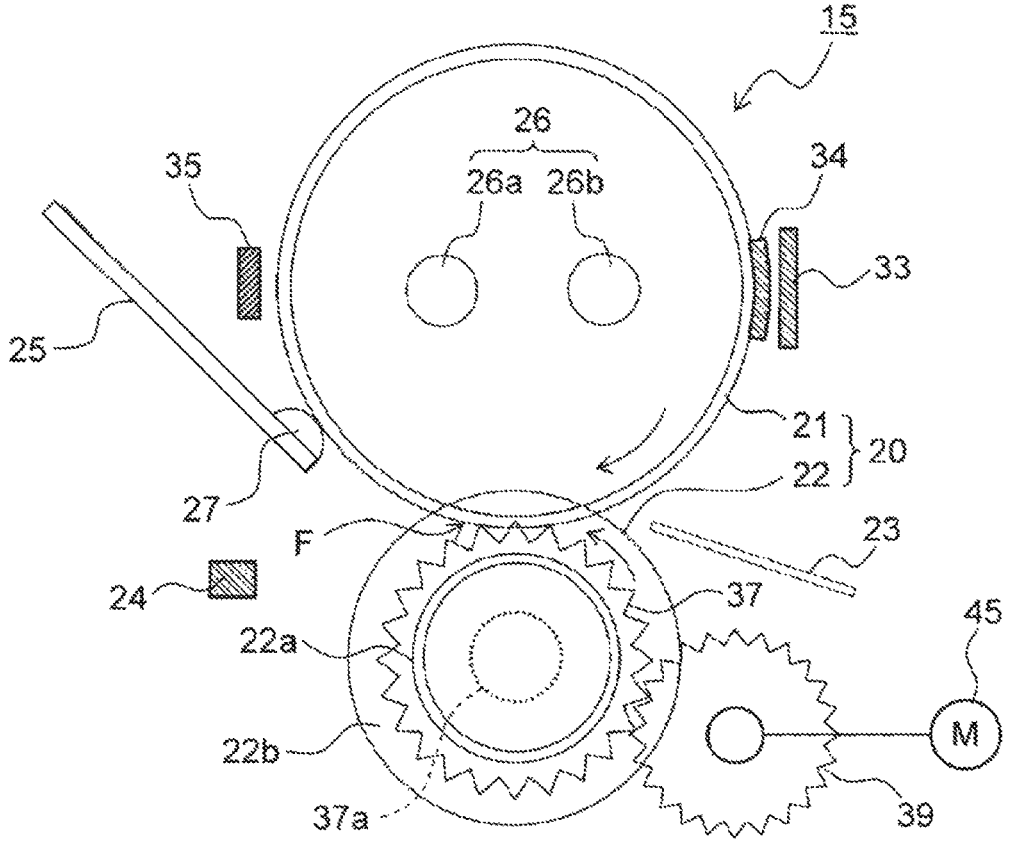
FIG. 2 is a side sectional view of the fixing device according to a first embodiment of the present disclosure.
Figure 3:
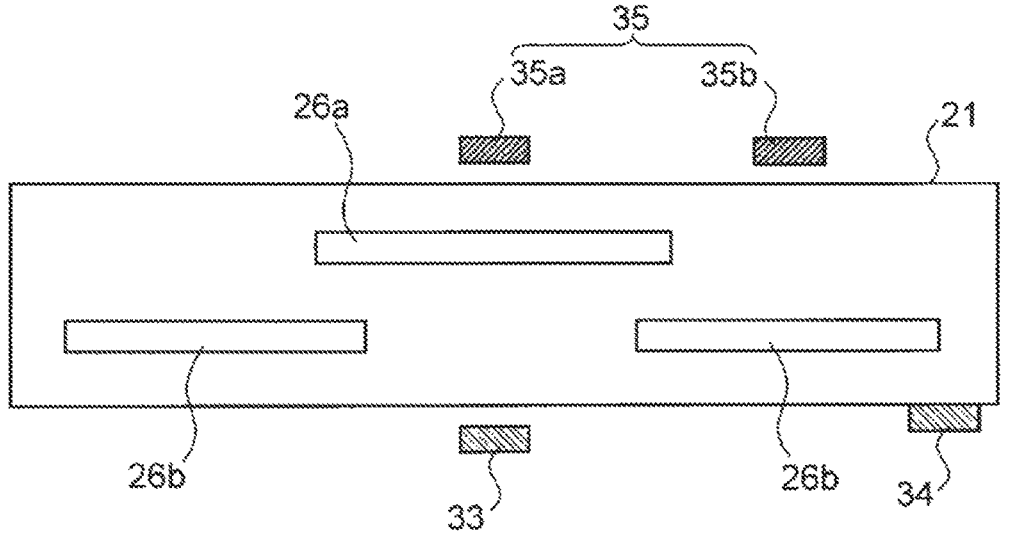
FIG. 3 is a plan sectional view of the fixing roller of the fixing device of the first embodiment as viewed from above.

FIG. 2 is a side cross-sectional view of the fixing device 15 according to a first embodiment of the present disclosure mounted on the image forming apparatus 100 shown in FIG. 1. FIG. 3 is a plan cross-sectional view of a fixing roller 21 of the fixing device 15 shown in FIG. 2 as viewed from above. The fixing device 15 includes a fixing roller pair 20, a fixing entry guide 23, a paper detection sensor 24, a separation plate 25, a first temperature sensor 33, and a second temperature sensor 34. The housing of the fixing device 15 is not shown in FIG. 2.

The fixing roller pair 20 is composed of the fixing roller 21 and a pressure roller 22. The fixing roller 21 is rotated in a clockwise direction in FIG. 2 by a fixing drive motor 41 (see FIG. 4). The pressure roller 22 has a core 22*a* and an elastic layer 22*b* laminated on the outer peripheral surface of the core 22*a*. The pressure roller 22 is brought into pressure contact with the fixing roller 21 at a predetermined pressure by a pressure adjusting mechanism 43 (see FIG. 4) to form a fixing nip portion F, and fixes an unfixed toner on the paper passing through the fixing nip portion F.

A drive input gear 37 is attached to the core 22*a* of the pressure roller 22. A drive output gear 39 is engaged with the drive input gear 37, and the drive output gear 39 is connected to a pressure drive motor 45. A torque limiter 37*a* is incorporated in the drive input gear 37. When the torque (rotational load) applied to the drive input gear 37 is smaller than a predetermined value, the torque limiter 37*a* rotates the drive input gear 37 together with the core 22*a* to transmit the rotational driving force of the pressure drive motor 45. On the other hand, when the torque applied to the drive input gear 37 becomes equal to or greater than a predetermined value, the torque limiter 37*a* rotates (idles) the drive input gear 37 independently of the core 22*a* to cut off the transmission of the rotational driving force of the pressure drive motor 45.

Examples of the configuration of the fixing roller 21 used in the present embodiment include a cylindrical aluminum core having a diameter of 30 mm, a thickness of 0.6 mm, and a crown amount (a difference in diameters between a central portion and both end portions in the axial direction) of 0.1 mm, and a coating layer (release layer) of PFA resin (Perfluoro alkoxy alkane) is laminated on the outer peripheral surface of the aluminum core. Examples of the configuration of the pressure roller 22 include a pressure roller 22 in which an elastic layer 22*b* made of silicone rubber is laminated on an aluminum core 22*a* and covered with a PFA tube (release layer).

A heater 26 is built in the fixing roller 21. The heater 26 is composed of a 600 W main heater 26*a* having a heat distribution peak at the center of the fixing roller 21 in the axial direction (the direction perpendicular to the paper surface of FIG. 2) and a 400 W sub heater 26*b* having heat distribution peaks at both ends in the axial direction. Although a halogen heater is used as the heater 26 in the present embodiment, an IH heater having an induction heating unit having an excitation coil and a core may be used instead of the halogen heater to heat the fixing roller 21 from the outside.

On the upstream side of the fixing nip portion F with respect to the paper conveying direction (from the right to the left in FIG. 2), there is provided the fixing entry guide 23 for guiding the paper to the fixing nip portion F. On the downstream side of the fixing nip portion F, there is provided the paper detection sensor 24 for detecting the passage of the paper. The paper detection sensor 24 is composed of, for example, a fixing actuator which projects on the paper conveying path and oscillates by the passage of the paper, and a PI (photo-interrupter) sensor which is turned ON or OFF by the oscillation of the fixing actuator.

The separation plate 25 for separating paper from the fixing roller 21 is disposed downstream of the fixing nip portion F with respect to the rotational direction (clockwise direction) of the fixing roller 21. The separation plate 25 is a plate-like member extending in the axial direction of the fixing roller 21, and separates the paper after being subject to the fixing process from the surface of the fixing roller 21.

A pair of spacing regulating members 27 are fixed to both ends of the separation plate 25 in the width direction (the direction perpendicular to the paper surface in FIG. 2), which are the upstream end portions (the lower right end portions in FIG. 2) of the separation plate 25 with respect to the paper conveying direction. The spacing regulating members 27 are brought into contact with of both ends of the outer peripheral surface of the fixing roller 21 in the axial direction, whereby the spacing between the upstream end of the separation plate 25 and the surface of the fixing roller 21 is set to a predetermined spacing.

The paper on which the toner image has been transferred by the transfer roller 14 (see FIG. 1) advances in the left direction in FIG. 2, is carried into the fixing device 15 from the upstream opening of the housing, and is guided to the fixing nip portion F of the fixing roller pair 20 along the fixing entry guide 23. When the paper passes through the fixing nip portion F, the paper is heated and pressurized with a predetermined temperature and pressure, and the toner image on the paper is made a permanent image. Thereafter, the paper is separated from the fixing roller 21 by the separation plate 25, is conveyed to the outside of the fixing device 15 from the downstream opening of the housing, and is discharged from the discharge roller pair 17 (see FIG. 1) to the outside of the image forming apparatus 100.

The first temperature sensor 33 and the second temperature sensor 34, made up of a thermistor, or the like, are disposed upstream of the fixing nip portion F with respect to the rotational direction of the fixing roller 21. The first temperature sensor 33 is disposed opposite the axial center portion of the fixing roller 21, and detects the surface temperature of the fixing roller 21 in a non-contact state. The second temperature sensor 34 is disposed in contact with one axial end portion of the fixing roller 21, and detects the surface temperature of the fixing roller 21 in a contact state. The detection results by the first temperature sensor 33 and the second temperature sensor 34 are transmitted to a control unit 90 (see FIG. 4), and the fixing temperature is controlled by turning on/off the currents flowing through the main heater 26*a* and the sub heater 26*b*.

A thermostat 35 is disposed on the downstream side of the fixing nip portion F with respect to the rotational direction of the fixing roller 21. The thermostat 35 includes a first thermostat 35*a* and a second thermostat 35*b*. The first thermostat 35*a* is disposed to face the axial center of the fixing roller 21, and cuts off the power supply to the main heater 26*a* when the temperature reaches or exceeds a predetermined temperature. The second thermostat 35*b* is disposed to face the axial end of the fixing roller 21, and cuts off the power supply to the sub heater 26*b* when the temperature reaches or exceeds a predetermined temperature.

FIG. 4 is a block diagram showing a control path of the image forming apparatus 100. Since various controls of various parts of the image forming apparatus 100 are performed when the image forming apparatus 100 is used, the control path of the entire image forming apparatus 100 becomes complicated. Therefore, the control paths which are necessary for the implementation of the present disclosure will be mainly described here. The description of the portions which have already been described will be omitted.

An image input unit 60 is a receiving unit for receiving image data transmitted from a personal computer or the like to the image forming apparatus 100. An image signal inputted from the image input unit 60 is converted into a digital signal and then sent to a temporary storage unit 94.

A voltage control circuit 51 is connected to a charging voltage power supply 52, a developing voltage power supply 53, a transfer voltage power supply 54, and a fixing voltage power supply 55, and each power supply is operated by an output signal from the control unit 90. Each power supply applies a predetermined voltage to the charging device 4, the developing voltage power supply 53 to the developing device 8, the transfer voltage power supply 54 to the transfer roller 14, and the fixing voltage power supply 55 to the heater 26 in the fixing roller 21 in accordance with a control signal from the voltage control circuit 51.

An operation unit 70 is provided with a liquid crystal display unit 71 and LEDs 72 for indicating various states, so as to indicate the state of the image forming apparatus 100, the image forming state, and the number of printing copies. Various settings of the image forming apparatus 100 are made from a printer driver of a personal computer.

The control unit 90 includes at least a CPU (Central Processing Unit) 91 serving as a central processing unit, a ROM (Read Only Memory) 92 serving as a read-only storage unit, a RAM (Random Access Memory) 93 serving as a read/write storage unit, the temporary storage unit 94 for temporarily storing image data and the like, a counter 95, and a plurality (two in this example) of I/Fs (interfaces) 96 for transmitting control signals to each apparatus in the image forming apparatus 100 and for receiving input signals from the operation unit 70.

The ROM 92 stores control programs for the image forming apparatus 100, numerical values necessary for control, and data which are not changed during use of the image forming apparatus 100. The RAM 93 stores necessary data generated during control of the image forming apparatus 100 and data temporarily necessary for control of the image forming apparatus 100.

The temporary storage unit 94 temporarily stores an image signal input from the image input unit 60 and converted into a digital signal. The counter 95 accumulates and counts the number of printed sheets.

When the paper carrying the unfixed toner image passes through the fixing nip portion F, if a toner external additive or a wax component adheres to the surface of the fixing roller 21, a surface releasing property or a surface resistance of the fixing roller 21 may change, which may cause hot offset, toner adhesion, and electrostatic offset.

Therefore, in the image forming apparatus 100 of the present embodiment, a fixing roller cleaning mode in which the adhesion on the surface of the fixing roller 21 is removed can be executed by rotating the fixing roller 21 and the pressure roller 22 with a linear speed difference when the sheet is not passed through the fixing nip portion F.

Figure 5:
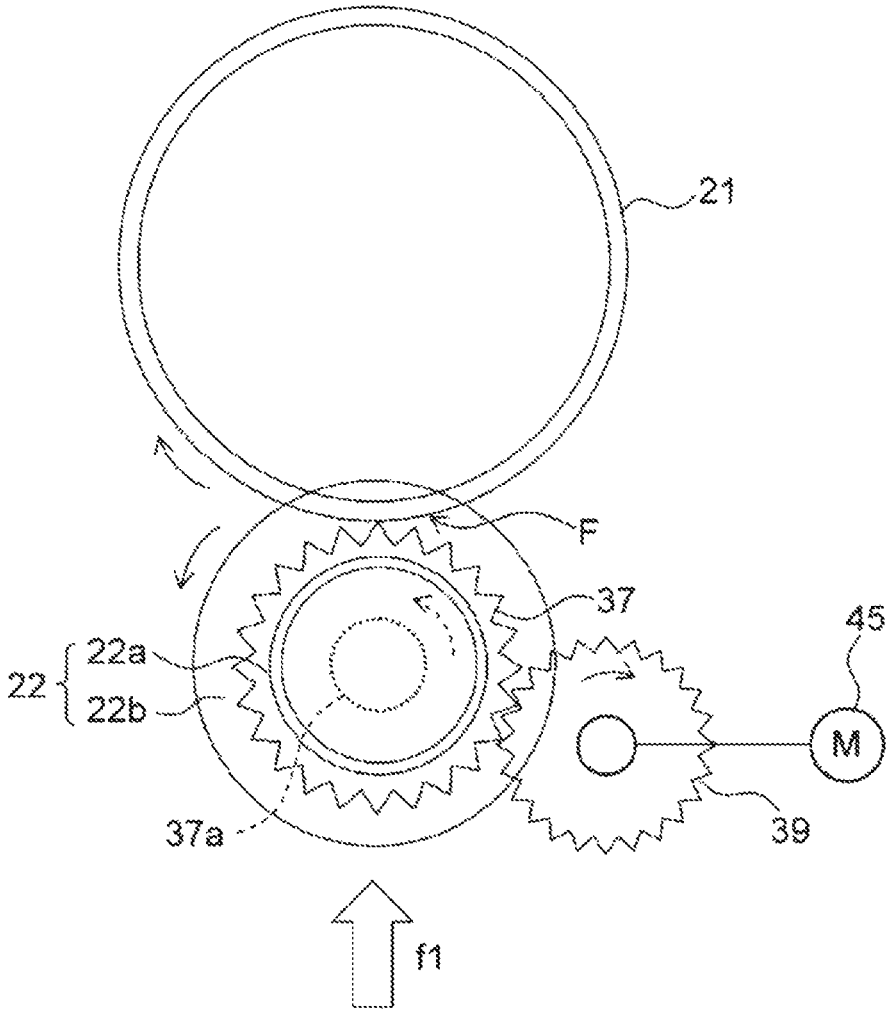
FIG. 5 is a side sectional view showing a driving state of the fixing roller and a pressure roller during a fixing operation.

FIG. 5 is a side cross-sectional view showing a driving state of the fixing roller 21 and the pressure roller 22 in a fixing operation. In the fixing operation shown in FIG. 5, the fixing roller 21 is rotationally driven at a predetermined linear speed by a fixing drive motor 41 (see FIG. 4). On the other hand, the pressure drive motor 45 connected to the pressure roller 22 via the drive output gear 39 and the drive input gear 37 outputs a rotational driving force such that the linear speed of the pressure roller 22 becomes higher than the linear speed of the fixing roller 21.

During the fixing operation, the pressure roller 22 is brought into pressure contact with the fixing roller 21 by the pressure adjusting mechanism 43 at a predetermined nip pressure f1 (first pressure). The torque limiter 37*a* incorporated in the drive input gear 37 is set such that a maximum torque (set torque) at which the drive can be transmitted is smaller than a load of the nip pressure f1.

In other words, during the fixing operation, since the load of the nip pressure f1 exceeds the set torque of the torque limiter 37*a*, the drive input gear 37 idles, and the rotational driving force of the pressure drive motor 45 is not transmitted. Therefore, the pressure roller 22 rotates following the fixing roller 21, and the linear speeds of the fixing roller 21 and the pressure roller 22 become the same.

Figure 6:
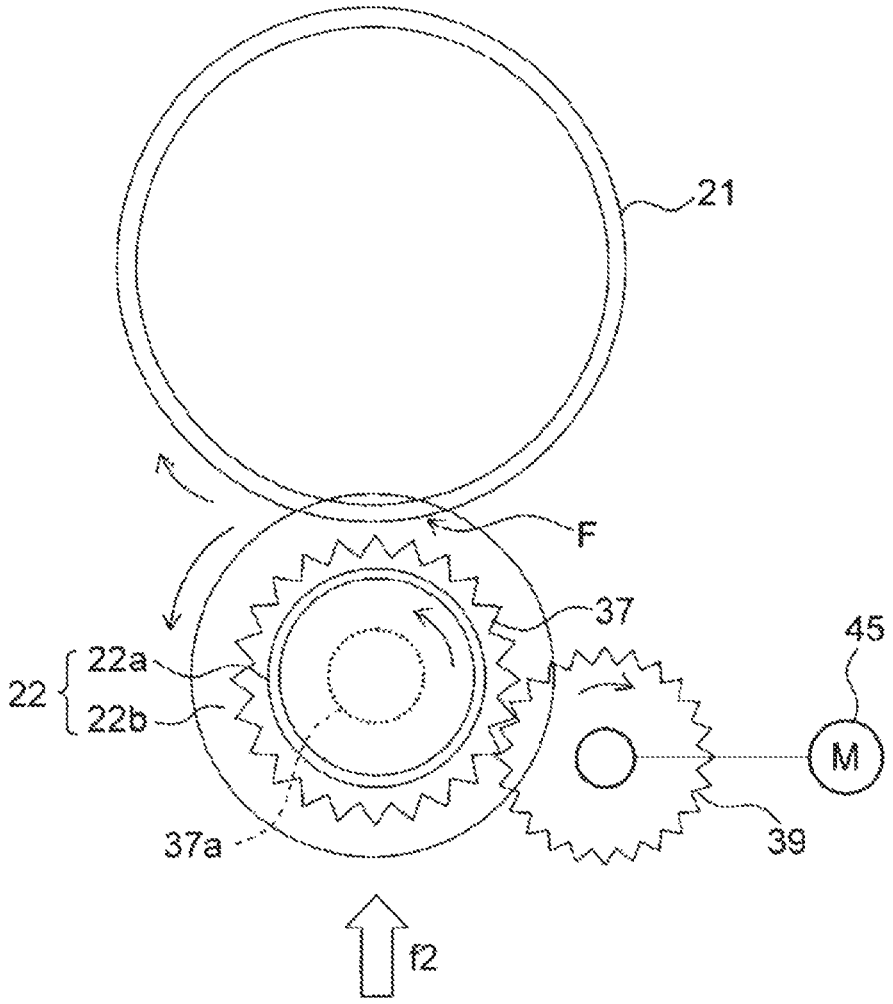
FIG. 6 is a side sectional view showing the driving state of the fixing roller and the pressure roller in a fixing roller cleaning mode.

FIG. 6 is a side sectional view showing the driving state of the fixing roller 21 and the pressure roller 22 in the fixing roller cleaning mode. In the fixing roller cleaning mode shown in FIG. 6, the pressure roller 22 is brought into pressure contact with the fixing roller 21 by the pressure adjusting mechanism 43 at a nip pressure f2 (second pressure), which is smaller than the nip pressure f1 and equal to or less than the set torque of the torque limiter 37*a*.

That is, in the fixing roller cleaning mode, since the nip pressure f2 is equal to or less than the set torque of the torque limiter 37*a*, the drive input gear 37 does not idle, and the rotational driving force of the pressure drive motor 45 is transmitted to the pressure roller 22 via the drive input gear 37, so that the pressure roller 22 rotates at a linear speed higher than that of the fixing roller 21.

By setting the nip pressure of the fixing nip portion to the second pressure, a linear speed difference (slip) is generated between the fixing roller 21 and the pressure roller 22, whereby adhesion on the surface of the fixing roller 21 is physically stripped off by sliding or rubbing between the surface of the fixing roller 21 and the surface of the pressure roller 22. As a result, adhesion on the surface of the fixing roller 21 can be suppressed from remaining. Further, since the nip pressure is set to the first pressure during the fixing operation in which the paper passes through the fixing nip portion F, the pressure roller 22 is rotated by the fixing roller 21, and a linear speed difference is not generated, the conveyance of the paper and the image quality are not affected.

Although the fixing roller cleaning mode can be executed every time the printing operation (one job) is completed, it is preferable to execute the fixing roller cleaning mode at a minimum frequency in which the adhesion does not remain on the surface of the fixing roller 21 in consideration of the load of the fixing drive motor 41 and the pressure drive motor 45, the abrasion of the surfaces of the fixing roller 21 and the pressure roller 22, and the like. Further, it is considered that the adhesion on the surface of the fixing roller 21 increases as the amount of unfixed toner on the paper contacting the fixing roller 21 increases.

Therefore, it is preferable to execute the fixing roller cleaning mode when a cumulative printing rate since the previous fixing roller cleaning mode reaches a predetermined value or more. Instead of relying on the cumulative printing rate, the fixing roller cleaning mode may be executed when a cumulative printing number since the previous fixing roller cleaning mode reaches a predetermined number.

Figure 7:
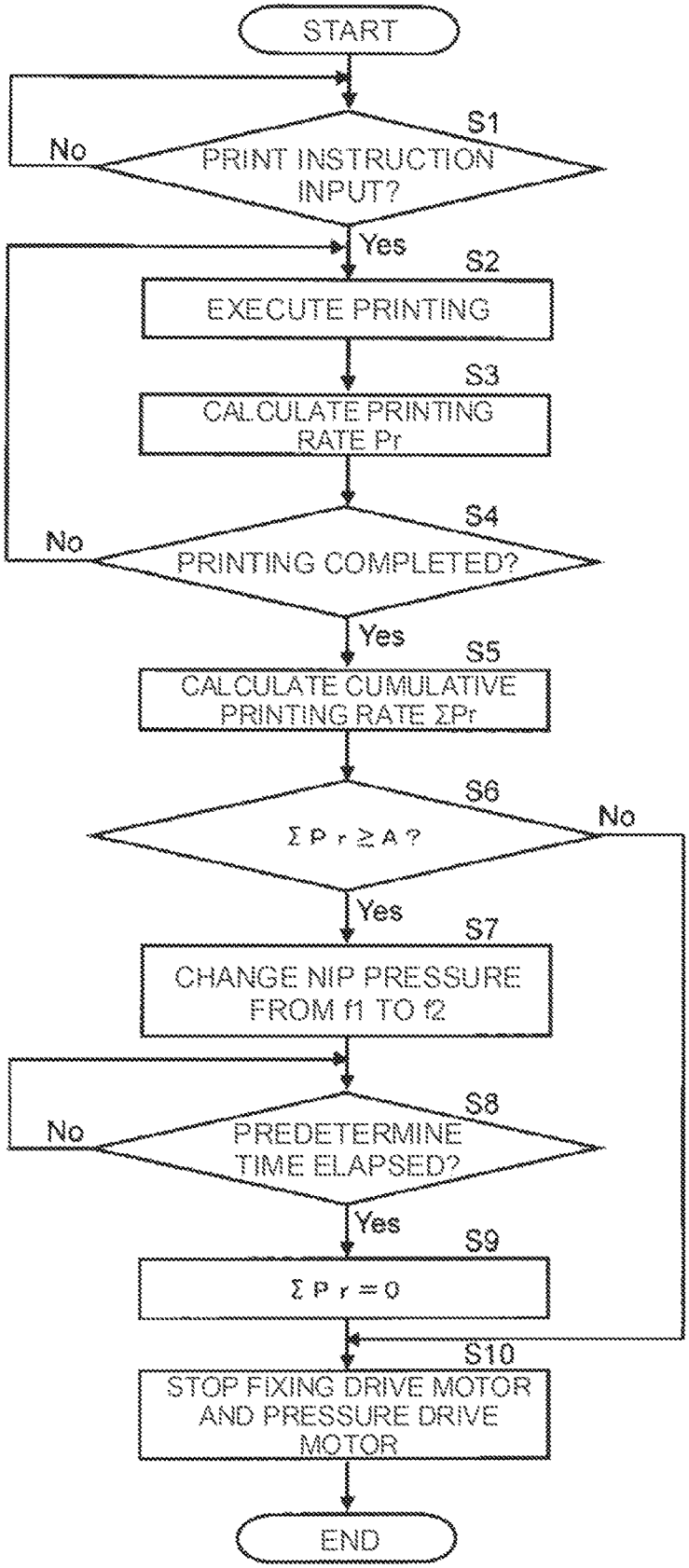
FIG. 7 is a flowchart showing an example of execution control of the fixing roller cleaning mode in the image forming apparatus.

FIG. 7 is a flowchart showing an example of execution control of the fixing roller cleaning mode in the image forming apparatus 100 according to the present embodiment. The execution procedure of the fixing roller cleaning mode will be described along the steps of FIG. 7 with reference to FIGS. 1 to 6 as needed.

First, the control unit 90 determines whether or not a print instruction has been received (step S1). If the print instruction has not been received (No in step S1), the control unit 90 continues the printing standby state. If the print instruction has been received (Yes in step S1), the control unit 90 executes printing (step S2). Specifically, the toner image is formed on the photosensitive drum 5 in the image forming unit P, and the toner image is transferred onto the paper by the transfer roller 14. Thereafter, the unfixed toner image on the paper is fixed in the fixing device 15. Further, the control unit 90 calculates the printing rate Pr of the image based on the image data input from the external device such as a personal computer to the image input unit 60 (step S3). The calculated printing rate Pr is stored in the RAM 93.

As shown in FIG. 5, at the start of image formation, the fixing roller 21 and the pressure roller 22 are in pressure contact with each other at the nip pressure f1, and there is no difference in linear speed between the fixing roller 21 and the pressure roller 22. Therefore, there is no risk of deterioration in conveyance and fixing properties of the paper passing through the fixing nip portion F.

Next, the control unit 90 determines whether or not printing has been completed (step S4). If printing has been completed (Yes in step S4), the control unit 90 calculates the cumulative printing rate ΣPr by accumulating the printing rates Pr stored in the RAM 93 (step S5), and determines whether or not the cumulative printing rate ΣPr is equal to or greater than a predetermined value A (step S6).

When ΣPr≥A (Yes in step S6), the control unit 90 executes the fixing roller cleaning mode. Specifically, the control unit 90 transmits a control signal to the pressure adjusting mechanism 43 to change the nip pressure between the fixing roller 21 and the pressure roller 22 from f1 to f2 (f1>f2) (step S7). As a result, as shown in FIG. 6, the rotational driving force of the pressure drive motor 45 is transmitted to the pressure roller 22 via the drive input gear 37, and a linear speed difference is generated between the fixing roller 21 and the pressure roller 22. As a result, the adhesion on the surface of the fixing roller 21 can be physically stripped off by the rubbing between the fixing roller 21 and the pressure roller 22.

Thereafter, the control unit 90 determines whether or not the predetermined time has elapsed (step S8). When the predetermined time has not elapsed, the rubbing between the fixing roller 21 and the pressure roller 22 is continued in a state where the nip pressure is changed to f2. When the predetermined time has elapsed, the cumulative printing rate ΣPr is reset (=0) (step S9), the fixing drive motor 41 and the pressure drive motor 45 are stopped (step S10), and the process ends.

On the other hand, when ΣPr<A (No in step S6), since the execution timing of the fixing roller cleaning mode has not been reached, the fixing drive motor 41 and the pressure drive motor 45 are stopped without executing the fixing roller cleaning mode (step S10), and the process ends.

According to the above-described control example, since the fixing roller cleaning mode is executed every time when the cumulative printing rate ΣPr reaches the predetermined value A, the fixing roller cleaning mode can be executed at the minimum frequency at which the adhesion does not remain on the surface of the fixing roller 21. Therefore, the load applied to the fixing roller 21, the pressure roller 22, the fixing drive motor 41, and the pressure drive motor 45 can be reduced as much as possible while effectively suppressing the occurrence of hot offset and electrostatic offset caused by the adhesion on the surface of the fixing roller 21, thereby extending the useful life (life) and reducing the running cost.

Although the cumulative printing rate ΣPr since the previous fixing roller cleaning mode is used as a trigger for executing the fixing roller cleaning mode in the control example of FIG. 7, the cumulative printing number may be used instead of the cumulative printing rate ΣPr.

Figure 8:
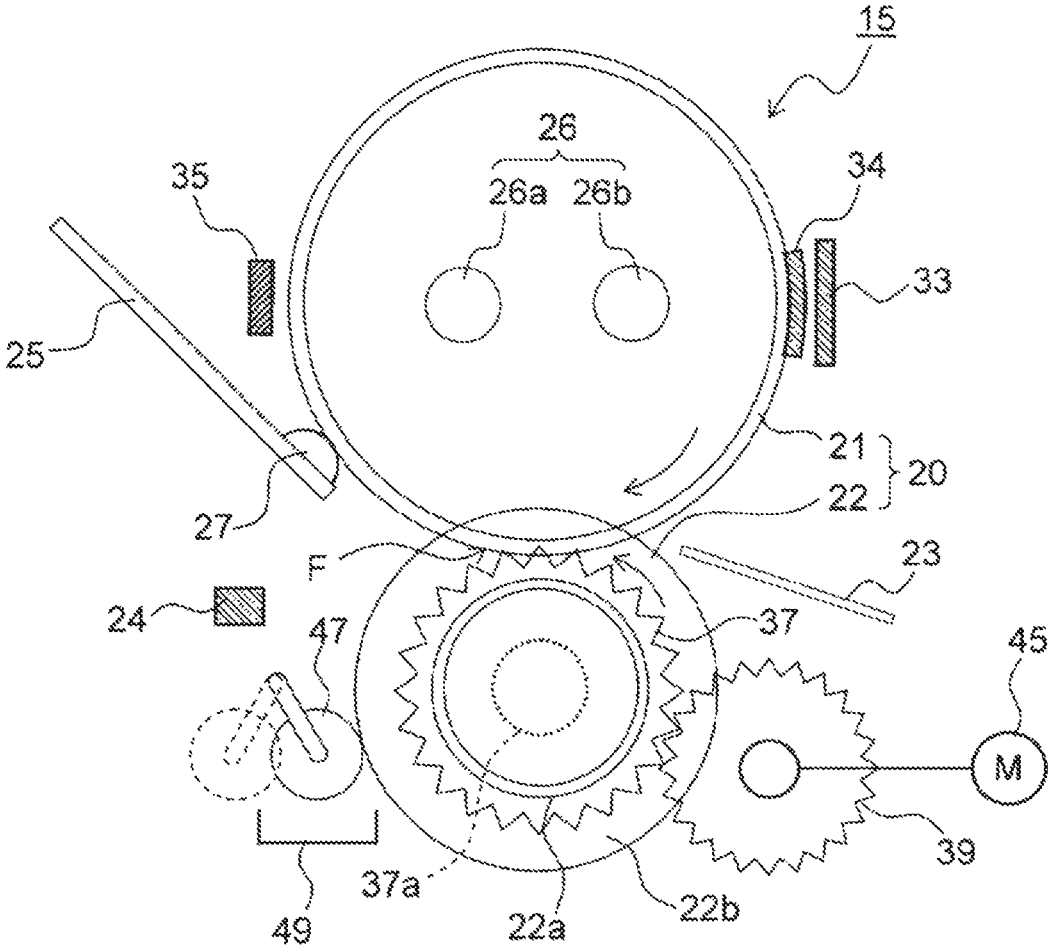
FIG. 8 is a side sectional view of the fixing device according to a second embodiment of the present disclosure.

FIG. 8 is a side cross-sectional view of the fixing device 15 according to a second embodiment of the present disclosure. The fixing device 15 according to the present embodiment includes a cleaning brush 47 for removing adhesions attached to the surface of the pressure roller 22 in the fixing roller cleaning mode, and a collection tray 49 for collecting substances attached to the surface of the pressure roller 22 removed by the cleaning brush 47. The configurations of other parts of the fixing device 15 are similar to those of the first embodiment shown in FIGS. 2 and 3.

As shown in FIG. 8, the cleaning brush 47 is movable between a cleaning position in contact with the pressure roller 22 (indicated by a solid line in FIG. 8) and a retraction position away from the pressure roller 22 (indicated by a broken line in FIG. 8). The control unit 90 (see FIG. 4) moves the cleaning brush 47 from the retraction position (indicated by the broken line in FIG. 8) to the cleaning position (indicated by the solid line in FIG. 8) at the timing of switching the nip pressure between the fixing roller 21 and the pressure roller 22 from f1 to f2, and moves the cleaning brush 47 from the cleaning position to the retraction position at the timing of switching the nip pressure from f2 to f1.

Thus, since the cleaning brush 47 is disposed at the retraction position during the fixing operation, the rotational load of the pressure roller 22 can be reduced, and the stable fixing operation can be performed. Also, since the cleaning brush 47 is disposed at the cleaning position during the fixing roller cleaning mode, the adhesion transferred from the fixing roller 21 to the pressure roller 22 can be efficiently collected, and fixing failure can be suppressed. Also, the life of the fixing device 15 including the pressure roller 22 can be extended.

Figure 9:
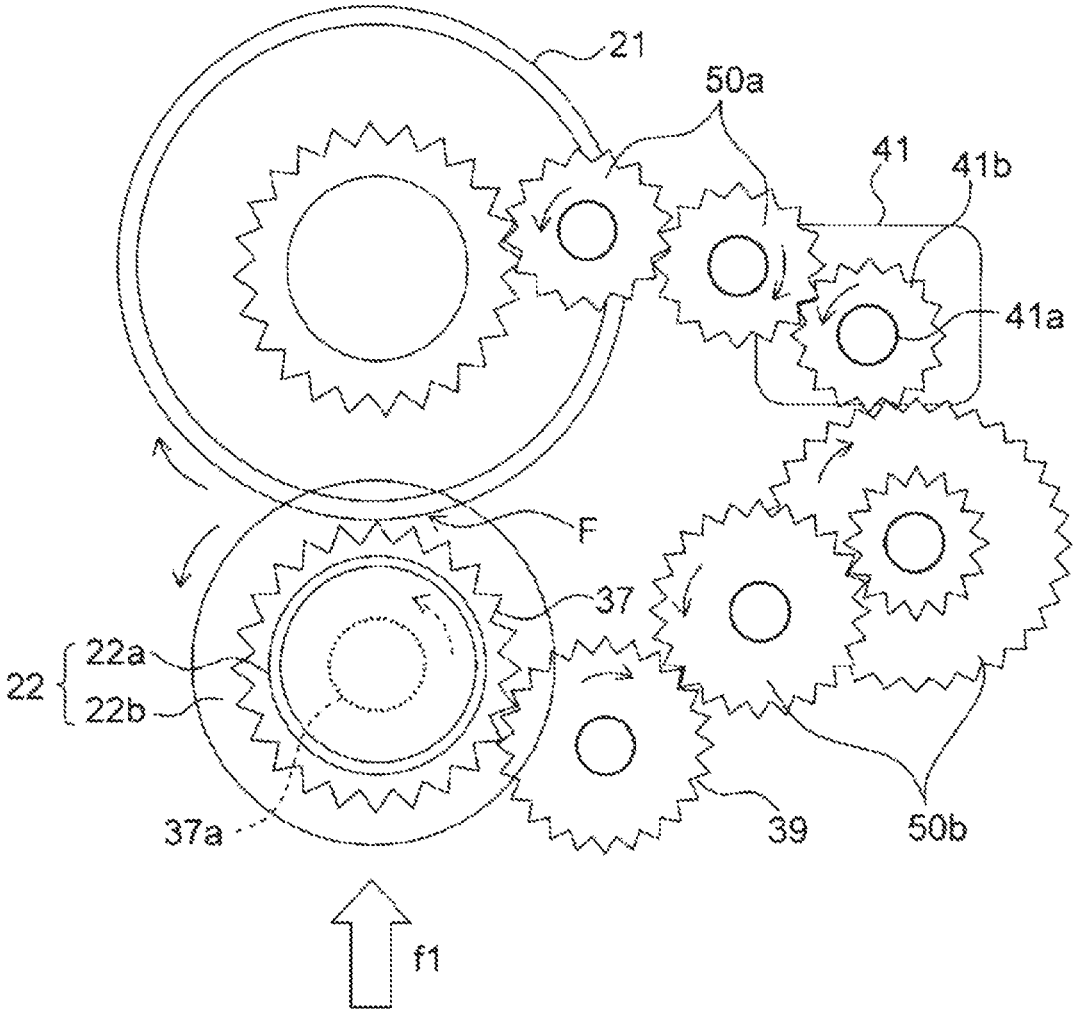
FIG. 9 is a side sectional view showing a drive mechanism of the fixing roller and the pressure roller constituting the fixing device according to a third embodiment of the present disclosure.

FIG. 9 is a side cross-sectional view showing a driving mechanism of the fixing roller 21 and the pressure roller 22 constituting the fixing device 15 according to a third embodiment of the present disclosure. In the present embodiment, the pressure drive motor 45 is not provided, and the rotational driving force is input to the fixing roller 21 and the pressure roller 22 from a pinion gear 41*b* fixed to an output shaft 41*a* of the fixing drive motor 41 through a first drive gear train 50*a* and a second drive gear train 50*b*. The configuration of other parts of the fixing device 15 is the same as that of the first embodiment shown in FIGS. 2 and 3.

The second drive gear train 50*b* for connecting the fixing drive motor 41 and the pressure roller 22 has a larger gear ratio than the first drive gear train 50*a* for connecting the fixing drive motor 41 and the fixing roller 21. Therefore, the pressure roller 22 can be driven at a higher linear speed than the fixing roller 21 in the fixing roller cleaning mode. Further, since the pressure drive motor 45 can be omitted, a cost of the fixing device 15 and the image forming apparatus 100 can be reduced.

The present disclosure is not limited to the above-described embodiments, and various modifications can be made without departing from the scope of the present disclosure. For example, in the above-described embodiments, the roller fixing type fixing device 15 for fixing toner by inserting the paper carrying the unfixed toner image into the fixing nip portion F formed by the fixing roller 21 and the pressure roller 22 has been described, but the present disclosure is also applicable to a belt fixing type fixing device in which an endless fixing belt is provided in place of the fixing roller 21, and the toner is fixed by inserting the paper carrying the unfixed toner image into the fixing nip portion formed by the fixing belt and the pressure member pressed against the fixing belt. When the present disclosure is applied to the belt fixing type fixing device, a structure is adopted in which sliding (slip) does not occur between the fixing belt and a belt driving roller abutting on an inner peripheral surface of the fixing belt.

Further, in each of the above-described embodiments, the linear speed of the pressure roller 22 is set higher than the linear speed of the fixing roller 21 in the fixing roller cleaning mode, but as long as the linear speed difference can be provided between the fixing roller 21 and the pressure roller 22, it is possible to strip off the deposit on the surface of the fixing roller 21. Therefore, the linear speed of the pressure roller 22 driven by the pressure drive motor 45 may be set lower than the linear speed of the fixing roller 21 driven by the fixing drive motor 41.

In the above embodiments, the torque limiter 37*a* is provided in the drive input gear 37 of the pressure roller 22, but any of the gears constituting the drive transmission gear train from the pressure drive motor 45 to the pressure roller 22, not limited to the drive input gear 37, may be a gear having the torque limiter built in.

In the second embodiment, the cleaning brush 47 is provided as the cleaning member for removing the adhesion on the surface of the pressure roller 22. However, a cleaning roller or a cleaning blade may be provided instead of the cleaning brush 47. In particular, it is preferable to provide the cleaning brush or the cleaning roller which rotates by being driven by the pressure roller 22 so as not to apply the rotational load to the pressure roller 22.

The present the present disclosure is not limited to the monochrome printer shown in FIG. 1, but can be applied to other image forming apparatuses having a fixing device, such as a color printer, monochrome and color copying machine, digital multi-function machine, or facsimile machine.

The present disclosure can be applied to the fixing device provided with a fixing member composed of a heated rotating body such as the fixing roller and a pressurizing member such as the pressure roller. The present disclosure provides the fixing device capable of suppressing adhesion of toner external additives and wax components to the surface of the heated rotating body with a simple configuration, and the image forming apparatus provided with the fixing device.

What is claimed is:

1. A fixing device comprising:

a first rotating member heated by a heating device;

a second rotating member which abuts against the first rotating member to form a fixing nip portion;

a first drive motor for rotationally driving the first rotating member;

a second drive motor for rotationally driving the second rotating member;

a torque limiter provided between the second rotating member and the second drive motor; and a pressure adjusting mechanism for adjusting a nip pressure between the first rotating member and the second rotating member, wherein when the nip pressure is a first pressure greater than a maximum torque that can be transmitted by driving the torque limiter, the second rotating member rotates following the first rotating member and at a same linear speed as a linear speed of the first rotating member, and when the nip pressure is a second pressure that is equal to or less than the maximum torque that can be transmitted by driving the torque limiter, the second rotating member is rotated by the second drive motor at a linear speed different from a linear speed of the first rotating member.

2. The fixing device according to claim 1, comprising a cleaning member selectively disposed at a cleaning position in contact with the second rotating member and at a retraction position spaced from the second rotating member, wherein the cleaning member is disposed in the retraction position when the nip pressure is the first pressure, and is disposed in the cleaning position when the nip pressure is the second pressure.

3. The fixing device according to claim 1, wherein the first drive motor is connected to the first rotating member via a first drive gear train and is connected to the second rotating member via a second drive gear train having a reduction ratio different from a reduction ratio of the first drive gear train, and the first drive motor also serves as the second drive motor.

4. The fixing device according to claim 1, being a roller fixing type having a fixing roller as the first rotating member and a pressure roller as the second rotating member.

5. An image forming apparatus comprising:

an image forming unit for forming a toner image on a recording medium;

the fixing device according to claim 1, the toner image formed by the image forming unit is fixed to the recording medium; and a control unit for controlling the image forming unit and the fixing device, wherein the control unit capable of executing a first rotating member cleaning mode in which the first rotating member and the second rotating member are rotationally driven by providing a linear speed difference between the first rotating member and the second rotating member by switching the nip pressure from the first pressure to the second pressure by the pressure adjustment mechanism during non-image formation.

6. The image forming apparatus according to claim 5, wherein the control unit executes the first rotating member cleaning mode when a cumulative printing rate or a cumulative printing number since a previous execution of the first rotating member cleaning mode reaches a predetermined value.

* * * * *